United States Patent [19]

Princevalle

[11] 4,237,753

[45] Dec. 9, 1980

[54] COFFEE FILTER PICKER

[76] Inventor: Peter Princevalle, 5 E. Quail St., Sparks, Nev. 89431

[21] Appl. No.: 19,072

[22] Filed: Mar. 9, 1979

[51] Int. Cl.[3] ..... B25B 27/00

[52] U.S. Cl. ..... 81/3 R

[58] Field of Search ..... 81/1 R, 3 R

[56] References Cited

U.S. PATENT DOCUMENTS

| | | | |
|---|---|---|---|
| 2,360,250 | 10/1944 | Mallard | 81/3 R |
| 3,072,428 | 1/1963 | Johnson | 81/3 R X |
| 3,844,185 | 10/1974 | Watson | 81/3 R |
| 3,955,449 | 5/1976 | Hofmeister et al. | 81/3 R |

*Primary Examiner*—James G. Smith

*Attorney, Agent, or Firm*—Mark C. Jacobs

[57] ABSTRACT

This invention relates to a novel device for separating an individual filter primarily used in coffee-makers from a compressed package containing a plurality of such filters.

10 Claims, 11 Drawing Figures

COFFEE FILTER PICKER

BACKGROUND OF THE INVENTION

One of the tasks that is least liked by restaurant personnel is the making of coffee. The reason for this is that such a chore takes away from tablewaiting time, thereby reducing tip income. During the course of this coffee-making chore, the waiter or waitress must separate a single coffee filter for use in the drip-type coffee-maker. Primarily commercial coffee-maker filters are generally bowl shaped, having a continuous fluted sidewall tapering upwardly and outwardly from a base portion. Such filters are generally about five to eight inches in diameter across the base portion, and are approximately three to five inches in length along the sidewall. Coffee filters of this nature are sold for such home coffee-makers as the Mr. Coffee ® coffee-maker and by Bun-O-Matic Corporation for commercial coffee-makers utilized in restaurants and catering facilities. Generally the filters are compressed into a bundle of about twenty-five units. Several bundles, usually four or six, are stacked together into a plastic bag for sale in the marketplace. It is due to the compression of the individual filters to reduce both shipment and storage space that the filters become difficult to separate one from another. Waiters and waitresses find that much time is lost in their manual attempt to separate one filter from a stack of same. It is necessary generally to utilize only one in order to ensure proper coffee manufacture as the use of a plurality of filters would tend to inhibit the flow of water through the plurality of filters.

Conversation with restaurant personnel indicates that there is no known device to aid the party making coffee to separate but one filter from a stack of compressed coffee filters. A search of the patent literature supports this conclusion.

It is an object of this invention therefore to provide a device to aid a person making coffee to separate one filter from a plurality of filters.

It is another object of this invention to provide a coffee filter picker which can be used to separate one filter from a stack of compressed coffee filters quickly and easily.

It is yet another object of this invention to provide a coffee filter picker which will separate a first filter from a plurality of same without damaging the first filter.

Yet another object is to provide a coffee filter picker that is easy to use and which can be manufactured at a very low price.

Other objects will in part be obvious and others will be readily discernible from a reading of the specification.

For a fuller understanding of the several aspects of the instant invention reference should be had to the following detailed description taken in conjunction with the drawings.

SUMMARY OF THE INVENTION

This invention relates to a coffee filter picker. That is, to a tool to be used to aid in the manual separation of a single filter from a plurality of same, which plurality has generally been compressed into a stack of about fifty such filters.

The tool of this invention permits the operator to separate but a single filter from a pack of two or more without damaging the others in the pack.

The tool is seen to include a handle terminating one end of a shaft, the other end of said shaft ending in a compound curve with a pointed tip, and a pivot arm secured to said shaft and extending generally normal thereto.

DESCRIPTION OF THE PREFERRED EMBODIMENT

The apparatus of this invention is one intended for the separation of one coffee filter from a pack containing several of same or from a stack usually of twenty-five or more. The device of this invention is seen to comprise four main parts. These are a handle, a main shaft which terminates in a compound curve section with a pointed tip, and a pivot arm.

Figure 1:
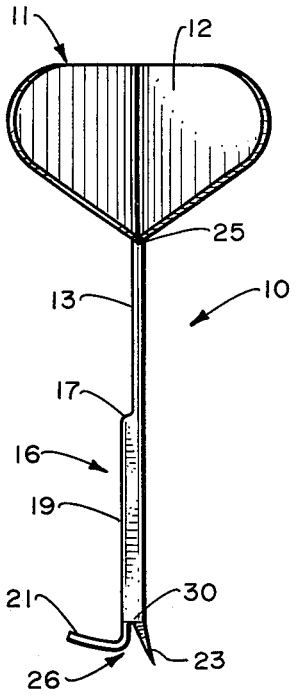
FIG. 1 is a top plan view of one embodiment of the coffee filter picker of this invention.

Thus, it is seen in FIG. 1 that the device 10 comprises an elongated main shaft 13 having a compoundedly curved lower section 15 terminating in a pointed tip 23. Main shaft 13 extends from handle 11 in the same plane. Auxilliary arm shaft 16 extends from said main shaft 13 at a point about midway between point 23 and the junction of shaft 13 with handle 11, namely point 25. The auxilliary arm shaft 16 has a main portion 19 extending generally parallel to shaft 13, said main portion curving into a secondary portion extending generally normal to said shaft 13 and away from said shaft 13 at a position approximately adjacent said curved lower section 15 to form a pivot support arm 21 for said main shaft.

Figure 9:
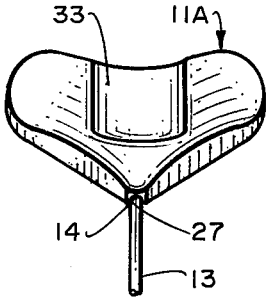
FIGS. 9, 10 and 11 show modified handle portions.

Shaft 13 includes distal end 14 which may be secured to the underside of handle 11. Handle 11 may be made of metal such that a distal end 14 of shaft 13 may be welded, soldered or brazed thereto, or handle 11 may be formed of plastic as seen in FIG. 9 such that the distal end of shaft 14 is inserted into a suitable bore 27 in the handle as shown in said FIG. 9. In this figure the handle is designated as 11A.

Figure 2:
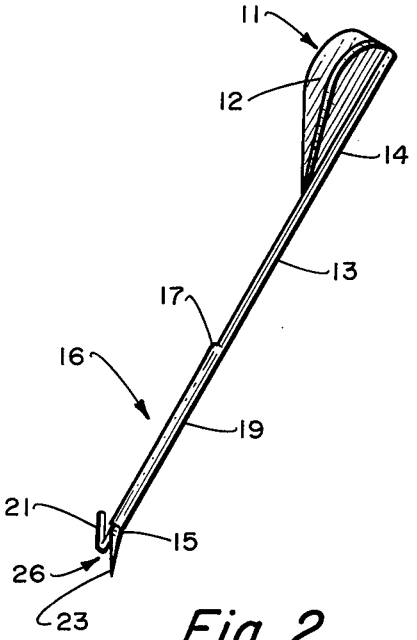
FIG. 2 is a perspective elevational view of the embodiment of FIG. 1.

As to the previously mentioned mode of construction reference should be had to FIG. 2.

Auxilliary arm 16 is preferably abutted to shaft 13 and secured thereto as by welding or soldering.

In FIG. 2 the device of FIG. 1 is depicted having been rotated approximately 90°. In this manner one can better recognize that handle 11 includes a central depressed section 12 shaped to conform to the curvature generally of the thumb of the operator. In addition, the angular relationship between arm 21 and curved lower section 15 of main shaft 13 can also be seen.

It is seen that first portion 17 of arm 16 is primarily for esthetics in that a blob of solder or plastic coating is disposed at the terminus of the junction of the generally L-shaped auxilliary arm shaft's 16 main portion 19 with main shaft 13 to smooth the lines of the device to create a pleasant looking device. Thus a hard right angle termination for the upper end of 19 could also be provided as portion 17 is non-functional and can be eliminated.

It is seen that arm 21 depends generally normal to the main shaft and slightly rearwardly from the lower edge of attachment to the main shaft 13. The lower edge of attachment of auxilliary arm shaft 16 terminates at a point 30 corresponding to the beginning of current lower section 15 of the main shaft 13. The space between arm 21 and section 15, designated 26, is generally an inverted V shape and serves to allow the operator to slightly bend arm 21 up or down as best suits the comfort of his position when operating the device.

Lower section 15 is compoundedly curved in that it depends from the vertical leftwardly and rearwardly from point 30 to top 23 as depicted for a right-handed model. For a left-handed version 15 would curve rightwardly and rearwardly.

Obviously, for a left-handed version, arm 21 would depend from the opposite side of shaft 13. It is important that there be a finite distance between tip 23 and the lower edge of arm 21 in order for tip 23 to be inserted into a filter. Thus, arm 21 depends generally horizontally at about the midpoint of the elevation of curved lower section 15.

Figure 3:
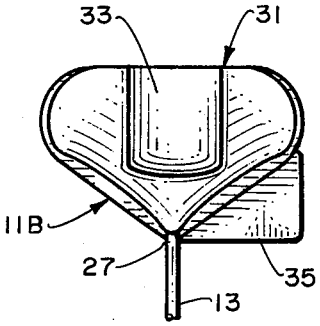
FIG. 3 is a top plan view of an alternate handle portion for the coffee filter picker of this invention.
Figure 4:
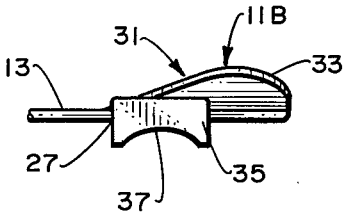
FIG. 4 is a side elevational view of the handle of FIG. 3.

In FIG. 3 an alternate embodiment of the handle made of plastic as shown in FIG. 9 is disclosed. Whereas the FIG. 9 handle constitutes a molded plastic handle similar to the metallic version as shown in FIG. 1, the version of the embodiment in FIG. 3 also includes finger receiving section 35 on the underside of the handle 31. This finger section 35 includes a recessed area 37 along the length thereof and normal to shaft 13. Details are best seen in FIG. 4, which is a side elevational view of the handle of FIG. 3. It is seen that shaft 13 is secured to the handle 31 by frictionally engaging same within bore 27 or by the use of a suitable adhesive to ensure a tight fit within said bore. This handle is designated 11B.

Figure 5:
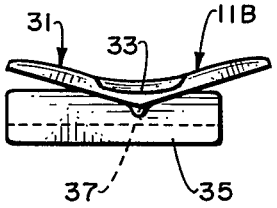
FIG. 5 is a rear elevational view of the handle as shown in FIG. 3.

FIG. 5 is a rear elevational view of the handle of FIG. 3. It is to be seen that it is within the skill of the art to reverse finger section 35 such that it projects to the opposite side of handle 31 than is shown in FIGS. 3 and 5. Such an alternate version would be of benefit to a left-handed person, whereas as shown, the handle is better suited for a right-handed person.

As is seen in FIGS. 3 and 9, the top surface of the handles 11B and 11A respectively include central depressed areas 33 corresponding to the general shape of the thumb. Whereas the handle 11 made of metal, per FIG. 1, is generally of a butterfly wing configuration primarily for ease of manufacturing. Obviously it is within the scope of the invention to employ a metal handle with a thumb depression area if desired.

Figure 10:
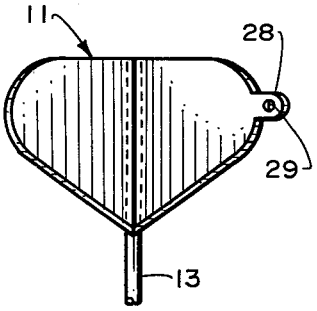
Figure 11:
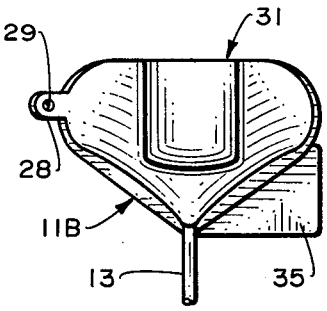

FIGS. 10 and 11 illustrate the further inclusion of a loss-prevention means securing the invention of this application to a static structure. Thus, a tab 28 having an aperture 29 therein may be soldered on the underside of a metallic handle per FIG. 10, said handle 11 being similar to the one of FIG. 1 or a tab 28 having the aperture 29 can be molded directly into the plastic handle of FIG. 3 as shown here in FIG. 11. A string or wire, not shown, would be knotted through the hole and secured at its opposite end to the coffee pot or some other static structure.

Though not specifically shown in the drawings, it is within the scope of the invention to provide a bore through handle 11 or handle 11A, 11B near the edge thereof rather than adding a tab with an aperture therein for the attachment of a string or wire to prevent loss of the device.

Operation of the Invention: The device of this invention may be used not only for basket-type coffee filters as such are known in the trade, made by Bunn-O-Matic, but for other manufacturers such as GHT Corp. of Wilmatt, IL for use with such home and industrial coffee makers as Mr. Coffee®, Westbend, Sunbeam, Regalware and Proctor Silex, among others.

Figure 6:
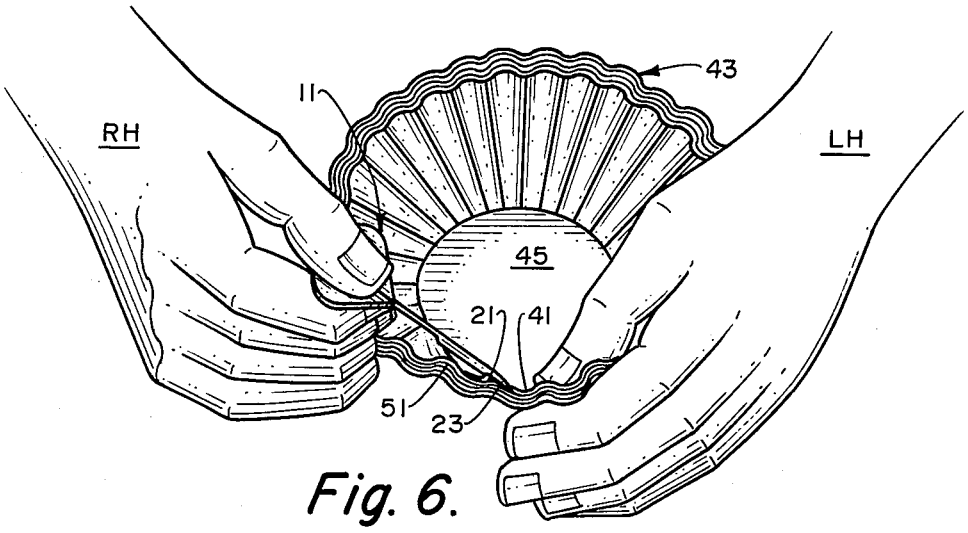
FIGS. 6, 7 and 8 depict the use of the coffee filter picker of this invention.
Figure 7:
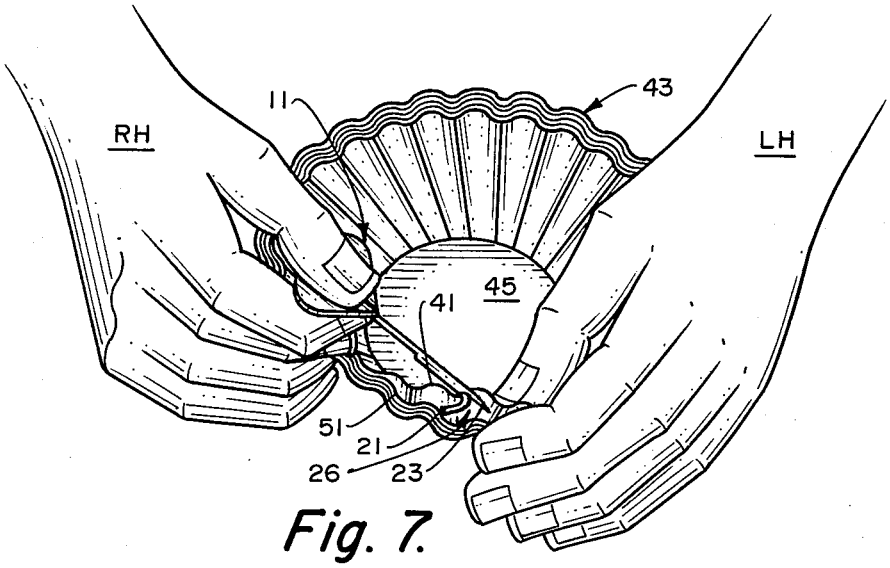
Figure 8:
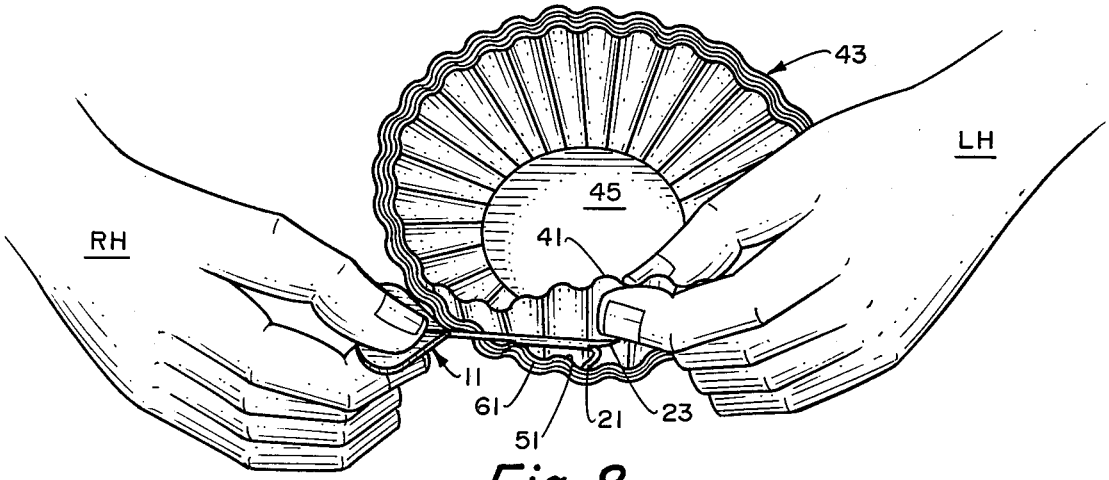

In operation, as is best seen from FIGS. 6, 7 and 8, the operator inserts the device of this invention with the right hand, assuming a right-handed version is being employed, into a stack of a plurality of coffee filters, the top most of which is designated 41, specifically into one of the flutes 43. The hands are disposed such that the arm 21 assumes a generally vertical position with the pointed tip 23 in a generally horizontal position, per FIG. 6. The tip 23 grabs the filter 41 and lifts it from the stack of filters. During the picking motion of FIG. 6, arm 21 acts as a guide or control means to prevent the tip from going in too deep such as to prevent more than one filter from a stack containing a plurality of same. Once separated, filter 41 is placed between the thumb and the index finger of the left hand such that these fingers can apply a force slightly upwardly to manually separate filter 41 from the filter next below, 51. At the same time the arm of the device is placed against filter 41 to provide a downward pressure to allow the left hand to complete the separation of filter 41 from filter 51. Reference is made specifically to FIG. 8.

It is seen therefore that the arm 21 serves a dual function in that it prevents tip from being inserted too deeply ab initio at the time of the original picking and further serves as an impediment to the upward motion of filter 51 such that filter 41 can be manually and totally separated from said filter 51 ie. the next adjacent below.

In FIG. 8 the designator 61 refers to the third most filter from the top; while LH and RH stand for left hand and right hand. The number 45 is the base portion of filter 43.

With respect to the construction of the device it is seen that the main shaft and auxilliary arm shaft 16 can be constructed of steel and one may be attached to the other as by soldering, brazing or spot welding. In order to comply with health regulations, the combined shaft may be chromium plated. Alternatively, the entire device except for the tip 23, which must be pointed, may be coated with a polymeric material such as epoxy or polyurethane.

The handle 11 may be manufactured from dished stamped metal as per FIG. 1 and FIG. 10 or from a suitable polymeric rigid plastic such as styrene or ABS for the embodiments of FIGS. 3, 9 and 11.

It is seen that I have described herein a novel device for use by restaurant personnel and homemakers for the separation of an individual basket-type coffee filter from a plurality of same. The device can be readily used with minimal training. By providing space 26 between arm 21 and 23, arm 21 may be slightly adjusted in order to accommodate for the hand motion of the operator of the device. This is deemed beneficial since not everyone's hands will fall to the positioning as depicted in FIGS. 6 through 8. It is seen therefore that while I have described in specifics the operation of the device, the hand positioning is not to be deemed critical, but is only relative and as such is to be considered illustrative only.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A device for manually separating fluted coffee filters comprising:

a main elongated shaft having a compoundedly curved lower section terminating in a pointed tip at one end, an auxilliary arm shaft extending from said main shaft at a point between said pointed tip and the top of said main shaft, said auxilliary arm shaft having a main portion secured along the length thereof parallel to said main shaft, said main portion curving into a secondary portion extending generally normal to said main shaft at a location on said main shaft spaced slightly upward from the tip of said main shaft.

2. The device of claim 1 further including a handle secured to the non-pointed end of said main shaft.

3. The device of claim 2 wherein said handle has a depressed central section generally conforming to the curvature of the human thumb.

4. The device of claim 3 wherein the one end of said main shaft is secured to the underside of said handle.

5. The device of claim 2 wherein said handle is of molded plastic, and the one end of said main shaft is fixedly secured in a bore in said handle.

6. The device of claim 5 wherein said handle includes a finger receiving section on the underside thereof.

7. The device of claim 2 wherein said handle further includes a tab mounted thereupon and having an aperture therein.

8. The device of claim 5 wherein said handle further includes a tab mounted thereon and having an aperture therein.

9. The device of claim 2 wherein said main shaft's compoundedly curved section depends leftwardly and rearwardly.

10. The device of claim 1 wherein said secondary portion depends horizontally at about the midpoint of the elevation of said curved lower section.

* * * * *